United States Patent [19]

Pomponi, Jr. et al.

[11] Patent Number: 4,759,502

[45] Date of Patent: Jul. 26, 1988

[54] SPRAY GUN WITH REVERSIBLE AIR/FLUID TIMING

[75] Inventors: Edward A. Pomponi, Jr., Niwot, Colo.; Walter Dany, River Vale, N.J.

[73] Assignee: Binks Manufacturing Company, Franklin Park, Ill.

[21] Appl. No.: 72,595

[22] Filed: Jul. 13, 1987

[51] Int. Cl.[4] ..... B05B 7/06

[52] U.S. Cl. ..... 239/8; 239/415; 239/528; 239/300; 137/630.19; 137/595

[58] Field of Search ..... 239/407, 414, 415, 527, 239/528, 290, 8, 11, 300; 137/630.19, 595, 867, 868

[56] References Cited

U.S. PATENT DOCUMENTS

| | | | |
|---|---|---|---|
| 1,908,848 | 5/1933 | Jenkins | 239/414 |
| 1,940,268 | 12/1933 | Peterson | 239/300 |
| 4,154,403 | 5/1979 | Forrester | 239/528 |
| 4,294,411 | 10/1981 | Hastings et al. | 239/415 |

*Primary Examiner*—Andres Kashnikow
*Assistant Examiner*—C. Trainor
*Attorney, Agent, or Firm*—Juettner Pyle Lloyd & Verbeck

[57] ABSTRACT

An air assisted hydraulic atomizing spray gun for liquid coating materials is characterized by an adjustable air/fluid turn on timing sequence which allows the air to be selectively turned on before, at the same time as, or after the fluid.

12 Claims, 2 Drawing Sheets

SPRAY GUN WITH REVERSIBLE AIR/FLUID TIMING

BACKGROUND OF THE INVENTION

The present invention relates to spray guns in general, and in particular to a pneumatically assisted hydraulic atomizing spray gun having improved air/fluid turn on timing.

Pneumatically assisted hydraulic atomizing apparatus for paint and other liquids is well known and has gained acceptance in the spray coating industry. Such an apparatus is often referred to as an air-assisted airless spray gun, and effects atomization of coating liquids through both pneumatic and hydraulic means. With such an apparatus, liquid coating material is hydraulically atomized by delivering the material under a relatively high hydrostatic pressure to and through a small selectively shaped orifice that forms the emitted liquid into a fan-shaped coherent film that atomizes into a spray at its forward end. Although the pressure of the coating liquid delivered to the orifice is sufficient to effect its atomization, it is less than sufficient to achieve a degree of atomization that is satisfactory for high quality coating purposes. Consequently, to improve the atomization, such air-assisted airless apparatus also includes means for directing one or more streams of air against the coherent film of coating liquid emitted from the orifice. The energy of the air is transferred to the film, with the result that the energy available for effecting atomization is increased and the degree of atomization is improved.

Air-assisted airless spray guns have fluid and air valves for controlling flows of coating liquid to the orifice and of air to an air nozzle. In accordance with conventional practice, the turn on timing of the fluid and air valves is controlled so that when the gun is turned on the air valve is opened before the fluid valve, and when the gun is turned off the fluid valve is closed before the air valve. However, the inventors have observed that with such an air-assisted airless spray gun, dried paint may be "spit" off of its fluid tip and onto product being painted, and have found that the cause of such "spitting" is attributable to the conventional air/fluid valve timing sequence. In particular, it has been found that the source of the dried paint was from a build-up of paint on the exterior of a fluid tip defining the selectively shaped orifice, which in turn resulted from air syphoning liquid coating material out of a cavity in the fluid tip behind the orifice and between the orifice and fluid valve. The syphoning effect occurs when the gun is triggered, because with a conventional gun the air comes on before and goes off after the fluid. Frequent triggering of the gun results in a build-up of paint on the tip, which eventually flakes off and is carried by the air and/or coating material to the article being painted.

OBJECTS OF THE INVENTION

An object of the present invention is to provide an improved air-assisted airless spray gun that does not have a tendency to "spit" dried paint off of its fluid tip onto product being painted.

Another object is to provide such a spray gun, in which elimination of "spitting" is achieved by controlling the air/fluid turn on and turn off timing of the gun, such that the fluid is turned on and off slightly before the air.

Yet another object is to provide such a spray gun in which the air/fluid valve timing of the gun is adjustable, so that the air may be selectively turned on before, at the same time as or after the fluid.

SUMMARY OF THE INVENTION

In accordance with the present invention, an apparatus for spray coating an article comprises a fluid nozzle including a selectively shaped orifice for transforming coating liquid delivered thereto into an expanding and coherent liquid film which atomizes into a spray at its forward edge, and fluid valve means for controlling delivery of coating liquid to the fluid nozzle. Also included is an air nozzle for directing a stream of air for impingement against the coherent liquid film, air valve means for controlling delivery of air to the air nozzle, and means for actuating the fluid and air valve means to control delivery of coating liquid and air to the fluid and air nozzles, such that the fluid valve means is actuated to permit the delivery of coating liquid to the fluid nozzle before the air valve means is actuated to permit the delivery of air to the air nozzle.

In a preferred embodiment, the actuating means is selectively adjustably controlled, so that the air valve means may be actuated to permit the delivery of air to the air nozzle either before, at the same time as or after the fluid valve means is actuated to permit the delivery of coating liquid to the fluid nozzle.

The invention also contemplates a method of operating a spray coating apparatus, which comprises the steps of delivering coating liquid to a fluid nozzle having a selectively shaped orifice for transforming coating liquid into an expanding and coherent film which atomizes into a spray at its forward edge, and delivering air to an air nozzle that emits a stream of air for impingement against the coherent liquid film. Also included is the step of controlling initiation of the delivery steps, so that fluid is delivered to the fluid nozzle before air is delivered to the air nozzle.

In accordance with a preferred embodiment of the method, initiation of the delivery steps is selectively controlled, so that air may be delivered to the air nozzle either before, at the same time as or after coating liquid is delivered to the fluid nozzle.

The foregoing and other objects, advantages and features of the invention will become apparent upon a consideration of the following detailed description, when taken in conjunction with the accompanying drawings.

DETAILED DESCRIPTION

Figure 1:
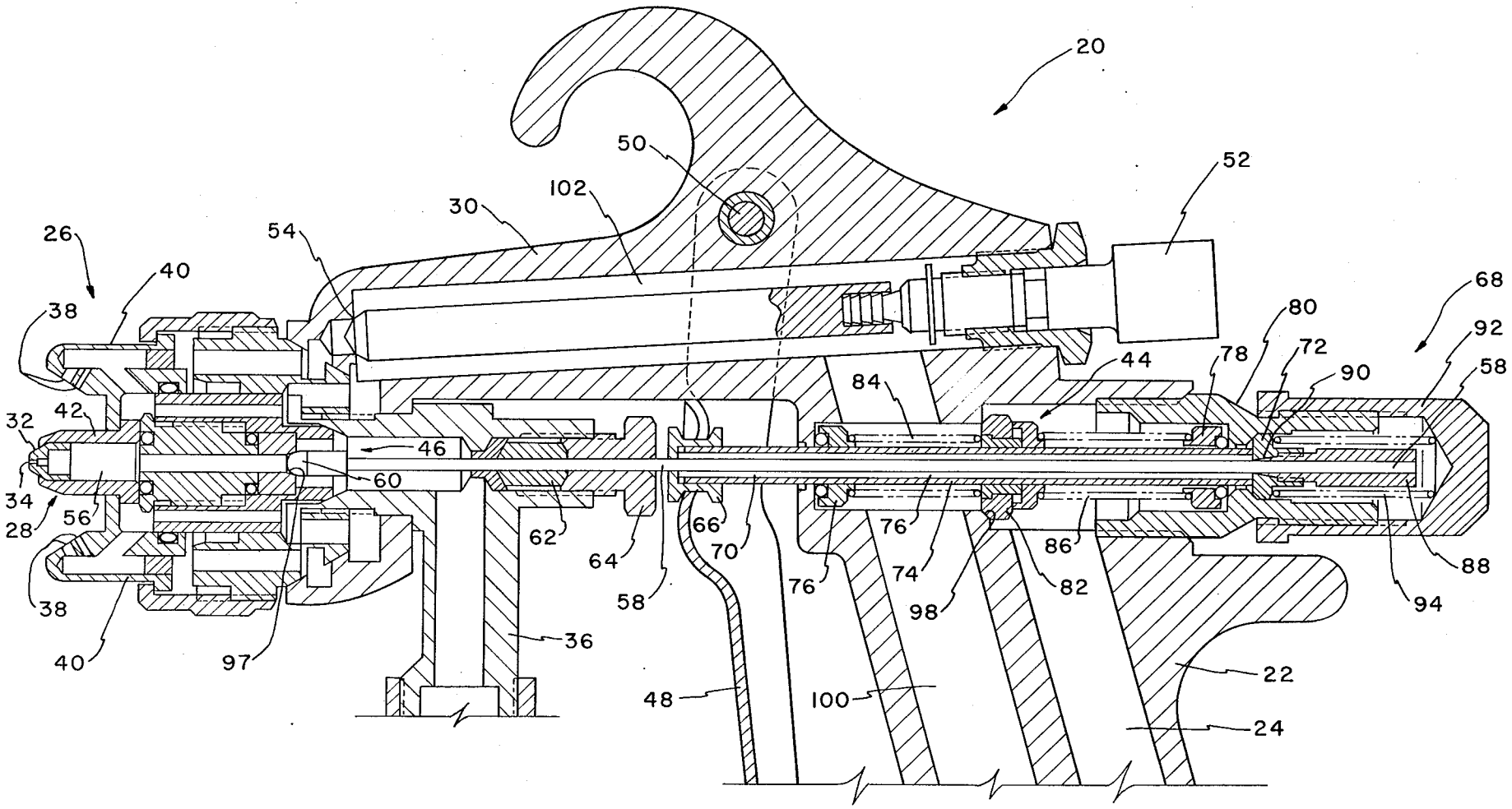
FIG. 1 is a cross sectional side elevation view of salient features of an air-assisted airless spray gun having adjustable air/fluid valve timing in accordance with the present invention, and illustrating a valve timing controller, at a rearward end of the gun, adjusted to cause a fluid valve of the gun to open prior to an air valve upon triggering of the gun.

Referring to FIG. 1, an air-assist airless spray gun, indicated generally at 20, includes a handle 22 having an air passage 24 adapted for connection at a lower end of the handle with a source of pressurized air. The gun also has an air nozzle, indicated generally at 26, and a fluid nozzle, indicated generally at 28, both carried at a forward end of a gun body portion 30. The fluid nozzle includes a fluid tip 32 having a selectively shaped orifice 34, to which liquid coating material is supplied at a relatively high pressure via a fluid inlet 36.

As is known, the pressure of coating liquid supplied to the fluid tip 32 is sufficient to cause it to be emitted from the orifice 34 in a thin, usually fan-shaped coherent film that atomizes into a spray at its forward end, but is less than sufficient to achieve a degree of atomization that ordinarily would be required for applying a satisfactory coating onto an article. Accordingly, to improve the degree of atomization, air is directed from the handle passage 24 to the air nozzle 26, from which it is emitted in streams from passages 38 in opposed air horns 40 for impingement against a fluid nozzle housing 42, that supports the fluid tip 32, and rebound against opposite surfaces of the coherent film of coating material emitted from the orifice. In this manner, some of the energy contained in the air streams is transferred to and increases the energy of the coherent film, so that increased energy is available for atomization of the coating material and the degree of atomization is increased.

To control the spraying operation, an air valve means, indicated generally at 44, is movable between open and closed positions to control a flow of air from the handle passage 24, through the gun body 30 and to the air nozzle 26, and a fluid valve means, indicated generally at 46, is movable between open and closed positions to control a flow of fluid from the fluid inlet 36 to the fluid nozzle 28. A manually manipulatable trigger 48 is operatively connected with the air and fluid valve means, and is mounted at its upper end to the gun body by a pivot pin 50. The trigger is movable between a gun off position away from the handle whereat the air and fluid valve means are closed, to a gun on position toward the handle whereat the air and fluid valve means are open, and a knob 52 adjusts the opening through a valve 54 to control the amount of air supplied to the air nozzle 26 when the gun is on.

To the extent described, the spray gun is known in the art and, if conventional, would have a timing relationship between the air and fluid valve means, such that upon movement of the trigger 48 to a gun on position toward the handle 22, the air valve means 44 would be opened to provide air to the air nozzle 26 before the fluid valve means 46 is opened to supply fluid to the fluid nozzle 28. However, a problem encountered with the conventional gun is that it has a tendency to "spit" dried paint off of the fluid tip 32 onto product being painted, and the inventors have determined that the source of the dried paint is from a build-up of paint on the exterior of the fluid tip, that results from air emitted by the air nozzle syphoning paint out of a cavity 56 behind the fluid tip and between the fluid tip and fluid valve means. Such syphoning occurs when the conventional gun is triggered on, because the air valve means opens before the fluid valve means. Frequent triggering of the gun results in a build-up of paint on the fluid tip, which eventually flakes off and is carried to the article being sprayed.

The inventors have discovered that the problem of dried paint "spitting" can be eliminated by reversing the customary air/fluid turn on timing sequence of the air-assisted airless spray gun 20, such that the fluid valve means 46, contrary to conventional thinking, is opened before the air valve means 44. Thus, in improving upon prior air-assisted airless spray guns, according to the invention the spray gun is provided with a mechanism that allows the opening sequence of the air and fluid valve means to be adjustably controlled, so that not only may the air valve means be opened after the fluid valve means is opened, but if desired it may also be opened either at the same time as or before the fluid valve means.

To accommodate control over the air/fluid valve means timing sequence, a valve stem 58 of the fluid valve means 46 carries a ball valve 60 at its forward end, from which the stem extends rearwardly through a packing 62, a material packing screw 64 and a valve spindle cap 66 to a valve timing adjusting mechanism, indicated generally at 68. A fluid valve control tube 70 extends around and is slidable along the stem between the spindle cap and a chuck lock 72 forward of the valve timing adjusting mechanism, and an air valve control tube 74 extends around and is slidable along the fluid valve control tube between the spindle cap and chuck lock. The fluid valve control tube 70 is longer than the air valve control tube 74, and each is received at its forward end within a rearward enlarged diameter passage in the spindle cap. The tube 74 extends through and is slidable within a housing 76 carried in a forward end of the gun handle 22 and a housing 78 carried in a retainer 80 threaded into a passage in the rearward end of the gun handle, and intermediate the housings 76 and 78 an air valve assembly 82 is press-fit onto the tube. A compression spring 84 extends between the housing 76 and air valve assembly, and a compression spring 86 extends between the air valve assembly and housing 78.

Figure 2:
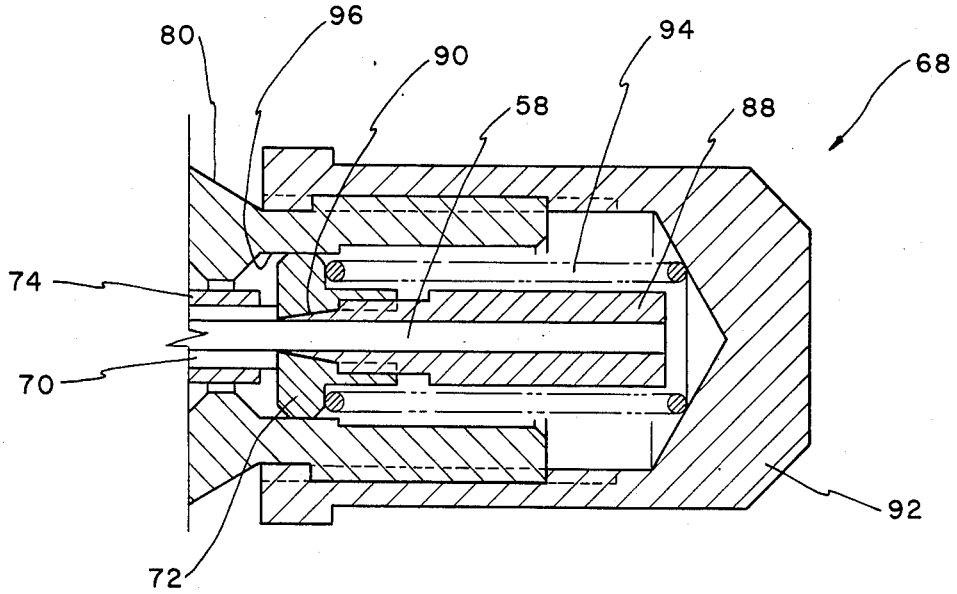
FIG. 2 is a cross sectional side elevation view of the valve timing controller, showing the same adjusted to cause the air and fluid valves to open at the same time upon triggering of the gun.
Figure 3:
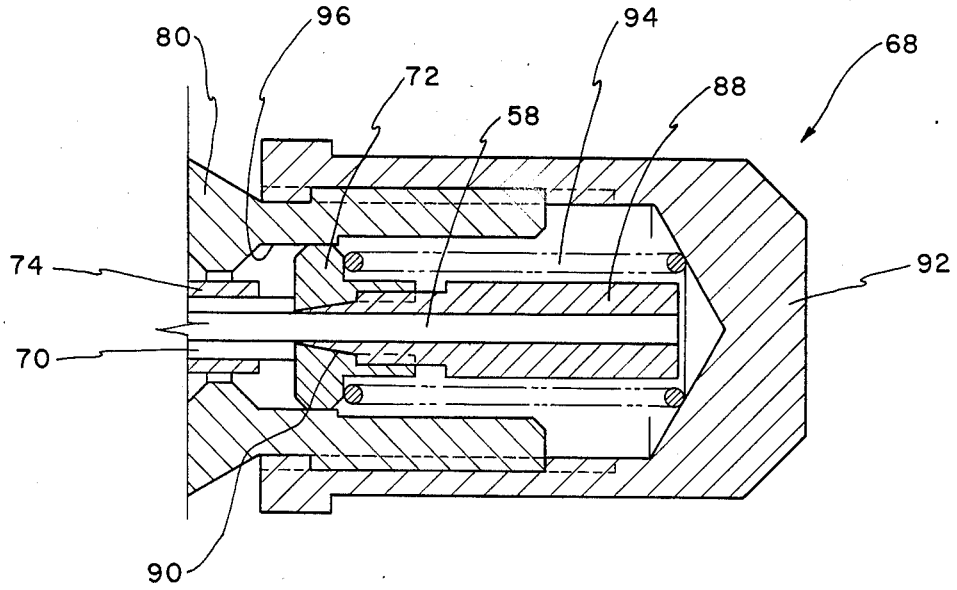
FIG. 3 is a cross sectional side elevation view of the valve timing controller, showing the same adjusted to cause the air valve to open before the fluid valve upon triggering of the gun.

With reference also to FIGS. 2 and 3, the valve timing adjusting mechanism 68 includes the forward chuck lock 72 through which the fluid valve stem 58 extends, together with a chuck 88 that grips the rearward end of the stem. A forward end of the chuck is threaded into a rearward end of the chuck lock, so that by virtue of tapered surfaces 90 on each of the chuck and chuck lock, upon being threaded into the chuck lock the chuck grips the stem for axial movement of the stem with the chuck and chuck lock. A cap 92 threaded onto a rearward end of the retainer 80 encloses the valve timing adjusting mechanism, and a compression spring 94 extends between a rearward shoulder of the chuck lock and the closed end of the cap to urge the chuck lock, chuck and stem forwardly through a retainer passage 96 to urge the ball valve 60 against a rearward valve seat 97 in the fluid nozzle 28.

When the gun is off, the air valve assembly 82 is urged by the spring 86 against a valve seat 98 formed in the air passage through the handle, and the air valve control tube 74, onto which the air valve assembly is press fit, is in its forwardmost position. To operate the gun in its mode in which the fluid valve means 46 is opened prior to the air valve means 44 when the gun is turned on by movement of the trigger 48 rearwardly, the chuck lock 72 and chuck 88 of the valve timing adjusting mechanism 68 are placed in a forward position on the fluid valve stem 58, such that with a rearward end of the fluid valve control tube 70 abutting the chuck lock, a forward end of the tube extends forwardly of a forward end of the air valve control tube 74. Thus, upon movement of the valve spindle cap 66 rearwardly by the trigger when the gun is turned on, the spindle cap engages and moves the fluid valve control tube 70 rearwardly, before it engages the air valve control tube 74, to move the chuck lock, chuck and valve stem rearwardly against the urging of the spring 94 to move the ball valve 60 off of its seat 97 and establish a path for a flow of fluid from the fluid inlet 36 to and through the fluid tip orifice 34. Then, and only after the fluid valve means 46 is opened, upon continued rearward movement of the trigger, the spindle cap engages the air valve control tube 74 to move the air valve assembly 82 off its seat 98 and establish a path for a flow of air from the handle passage 24, through a forward handle passage 100 and a gun body passage 102, to the air nozzle 26. Consequently, upon triggering the spray gun on, coating liquid is emitted from the gun prior to air, and upon turning the gun off, the flow of air is interrupted before the flow of coating liquid, so air cannot syphon coating liquid from the cavity 56 and deposit it on the surface of the fluid tip 32 to dry. The tendency for the spray gun to "spit" dried paint off of the fluid tip onto product being painted is therefore eliminated.

To operate the spray gun 20 in the mode in which coating liquid and air are emitted simultaneously upon turn on of the gun, since the fluid valve control tube 70 is longer than the air valve control tube 74, as shown in FIG. 2 the chuck lock 72 and chuck 88 are adjusted somewhat rearwardly on the fluid valve stem 58, such that with the rearward end of the tube 70 abutting the chuck lock, the forward ends of the tubes 70 and 72 are flush. Under this circumstance, when the gun is triggered on, the spindle cap 66 engages and moves the tubes simultaneously, and emission of air and coating liquid occur simultaneously.

To operate the spray gun in the conventional mode in which air is emitted before fluid, as shown in FIG. 3 the chuck lock 72 and chuck 88 are positioned further rearwardly on the fluid valve stem 58, such that with the rearward end of the tube 70 abutting the chuck lock, the forward end of the tube is rearwardly of the forward end of the tube 74. Consequently, upon movement of the trigger 48 rearwardly, the valve spindle cap 66 first engages the front end of the tube 74 and opens the air valve means 44 prior to engaging the front end of the tube 70 and opening the fluid valve means 46.

While embodiments of the invention have been described in detail, various modifications and other embodiments thereof may be devised by one skilled in the art without departing from the spirit and scope of the invention, as defined in the appended claims.

What is claimed is:

1. An apparatus for spray coating an article, comprising a fluid nozzle including a selectively shaped orifice for transforming coating liquid delivered thereto into an expanding and coherent liquid film which atomizes into a spray at its forward edge; fluid valve means for controlling delivery of coating liquid to said fluid nozzle; an air nozzle for directing a stream of air for impingement against the coherent liquid film; air valve means for controlling delivery of air to said air nozzle; and means for actuating said fluid and air valve means to control delivery of coating liquid and air to said fluid and air nozzles, such that said fluid valve means is actuated to permit the delivery of coating liquid to said fluid nozzle before said air valve means is actuated to permit the delivery of air to said air nozzle.

2. Apparatus as in claim 1, wherein said means for actuating further controls delivery of coating liquid and air to said fluid and air nozzles, such that said air valve means is deactuated to interrupt delivery of air to said air nozzle before said fluid valve means is deactuated to interrupt delivery of coating liquid to said fluid nozzle.

3. Apparatus for spray coating an article, comprising a fluid nozzle including a selectively shaped orifice for transforming coating liquid delivered thereto into an expanding and coherent liquid film which atomizes into a spray at its forward edge; fluid valve means for controlling delivery of coating liquid to said fluid nozzle; an air nozzle for directing a stream of air for impingement against the coherent liquid film; air valve means for controlling delivery of air to said air nozzle; means for actuating said fluid and air valve means to control delivery of coating liquid and air to said fluid and air nozzles; and means for controlling said actuating means so that said air valve means may be selectively is actuated to permit the delivery of air to said air nozzle either before, at the same time as, or after said fluid valve means is actuated to permit the delivery of coating liquid to said fluid nozzle.

4. Apparatus as in claim 3, wherein said means for actuating comprises a first member that is movable to actuate said fluid valve means, a second member that is movable to actuate said air valve means, and means for engaging and moving said first and second members, and said means for selectively controlling said actuating means comprises adjustment means for selectively controlling said means for engaging and moving to engage and move said second member, to actuate said air valve means, either before, at the same time as or after engagement and movement of said first member to actuate said fluid valve means.

5. Apparatus as in claim 4, wherein said first and second members are elongate and parallel and one of said members is longer than the other, said means for engaging and moving engages one end of each of said members to move the same, said valve means actuated by said longer one of said members is actuated by engagement of the same with an opposite end of said longer member, and said adjustment means comprises means for controlling the spacing of said valve means actuated by said longer member from said opposite end of said longer member.

6. Apparatus as in claim 3, wherein said means for actuating comprises a first elongate and longitudinally movable tubular member, a second elongate and longitudinally movable tubular member extended around said first tubular member, said first tubular member being longer than said second tubular member, and means for engaging first ends of said first and second members to move said members longitudinally, said air valve means being mounted on said second tubular member for being actuated upon movement of said second tubular member and said fluid valve means being positioned to be engaged and actuated by a second and opposite end of said first tubular member, and said means for selectively controlling said actuating means comprises means for selectively adjusting the spacing of said fluid valve means from said first tubular member second end, so that upon engaging said first ends of and moving said tubular members said second tubular member is moved to actuate said air valve means either before, at the same time as or after said first tubular member opposite end engages and actuates said fluid valve means.

7. A method for spray coating an article, comprising the steps of delivering coating liquid to a fluid nozzle having a selectively shaped orifice for transforming coating liquid delivered thereto into an expanding and coherent film which atomizes into a spray at its forward edge; delivering air to an air nozzle which directs a stream of air for impingement against the coherent liquid film; and controlling initiation of said delivery steps so that coating is delivered to the fluid nozzle before air is delivered to the air nozzle.

8. A method as in claim 7, including the step of controlling termination of said delivery steps to interrupt delivery of air to the air nozzle before interrupting delivery of coating liquid to the fluid nozzle.

9. A method for spray coating an article, comprising the steps of delivering coating liquid to a fluid nozzle having a selectively shaped orifice for transforming coating liquid delivered thereto into an expanding and coherent film which atomizes into a spray at its forward edge; delivering air to an air nozzle which directs a stream of air for impingement against the coherent liquid film; and selectively controlling initiation of said delivering steps so that air is delivered to the air nozzle either before, at the same time as or after coating liquid is delivered to the fluid nozzle.

10. A method of operating an apparatus for spray coating an article, wherein the apparatus has a fluid nozzle including a selectively shaped orifice for transforming coating liquid delivered thereto into an expanding and coherent liquid film which atomizes into a spray at its forward edge, an air nozzle for directing a stream of air for impingement against the coherent liquid film, and fluid and air valves for respectively controlling delivery of coating liquid and air to the fluid and air nozzles, said method comprising the steps of actuating the fluid valve to deliver coating liquid to the fluid nozzle, actuating the air valve to deliver air to the air nozzle, and controlling said actuating steps so that, upon initiation of delivery of coating liquid and air, the fluid valve is actuated before the air valve.

11. A method as in claim 10, including the steps, upon termination of delivery of coating liquid and air, of deactuating the fluid valve to interrupt delivery of coating liquid to the fluid nozzle, deactuating the air valve to interrupt delivery of air to the air nozzle, and controlling said deactuating steps so that the air valve is deactuated before the fluid valve.

12. A method of operating an apparatus for spray coating an article, wherein the apparatus has a fluid nozzle including a selectively shaped orifice for transforming coating liquid delivered thereto into an expanding and coherent liquid film which atomizes into a spray at its forward edge, an air nozzle for directing a stream of air for impingement against the coherent liquid film, and fluid and air valves for respectively controlling delivery of coating liquid and air to the fluid and air nozzles, said method comprising the steps of actuating the fluid valve to deliver coating liquid to the fluid nozzle, actuating the air valve to deliver coating liquid to the air nozzle, and selectively controlling said actuating steps so that, upon initiation of delivery of fluid and air, the air valve is actuated either before, at the same time as or after the fluid valve.

* * * * *